US005699817A

United States Patent [19]

Bankert et al.

[11] Patent Number: 5,699,817

[45] Date of Patent: Dec. 23, 1997

[54] TURBULENT FLOW CONDUIT CLEANING APPARATUS

[75] Inventors: Peter J. Bankert, Birmingham, Ill.; Mark Perry, Wixom, Mich.; Richard Grady, Eden Prairie, Minn.

[73] Assignee: Graco Inc, Minneapolis, Minn.

[21] Appl. No.: 439,330

[22] Filed: May 11, 1995

[51] Int. Cl.[6] ..... B08B 9/06

[52] U.S. Cl. ..... 134/102.2; 134/169 C

[58] Field of Search ..... 134/22.12, 80, 134/31, 37, 102.1, 102.2, 169 C

[56] References Cited

U.S. PATENT DOCUMENTS

| | | | |
|---|---|---|---|
| 2,244,159 | 6/1941 | Hunter | 134/102.1 X |
| 2,366,969 | 1/1945 | Kiggins | 134/102.1 X |
| 2,510,701 | 6/1950 | Cross | 134/95 |
| 2,681,657 | 6/1954 | Griffith | 134/98 |
| 2,818,076 | 12/1957 | Erling | 134/169 C |
| 3,116,743 | 1/1964 | Sparr | 134/169 C |
| 3,180,759 | 4/1965 | Falk | 134/22.12 |
| 4,771,503 | 9/1988 | Urbani | 134/104 X |
| 4,858,632 | 8/1989 | Jay, Jr. et al. | 134/169 C |
| 4,878,517 | 11/1989 | Prange | 137/355.12 |
| 4,881,563 | 11/1989 | Christian | 134/166 |
| 4,919,154 | 4/1990 | Engle | 134/22.12 |
| 5,024,245 | 6/1991 | Jay, Sr. et al. | 134/108 |
| 5,045,352 | 9/1991 | Mueller | 134/22.12 X |
| 5,076,856 | 12/1991 | Schweiger | 134/18 |
| 5,282,889 | 2/1994 | Franklin | 134/18 |
| 5,287,867 | 2/1994 | Plummer et al. | 134/56 |
| 5,322,571 | 6/1994 | Plummer et al. | 134/22.12 |
| 5,366,562 | 11/1994 | Schwarze et al. | 134/22.12 |

*Primary Examiner*—Arlen Soderquist
*Assistant Examiner*—Saeed Chaudhry
*Attorney, Agent, or Firm*—Douglas B. Farrow

[57] ABSTRACT

A system for cleaning of piping system using turbulent flow is provided by providing an input of a fixed flow rate of compressed air and a fixed flow rate of cleaning fluid. The fixed fluid flow is provided by either using an electric pump which may be controlled to do so or by restricting the air outlet of an air operated pump such that only a given amount of fluid will be delivered regardless of the pressure of the system into which the fluid is being delivered.

1 Claim, 1 Drawing Sheet

TURBULENT FLOW CONDUIT CLEANING APPARATUS

BACKGROUND OF THE INVENTION

In automotive assembly plants and other similar industrial applications, paint circulating systems are commonly in use. While such circulating systems are normally filled with circulating paint, periodically it is desired to clean the system either for general maintenance purposes or for the reason that the color in any given piping loop will be changed.

The traditional cleaning method provided circulation of large amounts of solvent through the circulating loop until the pipe became clean. Later, U.S. Pat. Nos. 5,322,571 and 5,287,867 provided a method of cleaning which greatly reduced the amount of solvent required. While the method and apparatus shown in these two patents is effective, it does require a precise balancing of the fluid and air pressures to ensure the correct mixture of air and fluid in order to obtain the desired turbulent flow. Without the balancing, the fluid flow rate may vary widely with very small changes in either the air pressure or the fluid pressure.

SUMMARY OF THE INVENTION

It is therefore an object of this invention to provide a system which will clean a piping system using turbulent flow yet which is easily and inexpensively manufactured.

It is further an object of this invention to provide a cleaning system which may be easily operated and which is economical in its use of solvent and energy and yet which will clean the system quickly.

While the balancing referred to above is necessary if the fluid source is pressure regulated, the balancing requirement can be eliminated if the fluid source uses a pump which has the following characteristics: (1) variable speed; (2) positive displacement; and (3) a constant speed output at any given pump setting.

Such a fluid source can be obtained in (at least) three different ways. First, pneumatic positive displacement pumps such as the pumps sold by Graco Inc. under the GLUTTON, HIGH-FLO, HUSKY, CHECKMATE and DURAFLO trademarks are provided with a special air control valve on the air exhaust. This control valve controls the air flow rate to the pneumatic motor and thus controls the speed of the motor independent of the fluid and air pressure. The flow control valve makes Graco's pneumatic pumps constant speed pumps once the valve is set. A manual adjustment to the valve will change the flow rate as desired.

Secondly, Graco Inc.'s TRIUMPH electrically driven reciprocating piston pumps provide "smart" motor control for Graco's positive displacement reciprocating piston pump. The "smart" motor can provide variable pump settings and constant flow rate at any given pump setting.

Lastly, a positive displacement gear pump with an electric motor controlled by a variable frequency controller will maintain a constant speed at any given motor set point. Utilizing any one of these three types of fluid sources in conjunction with pressurized air (or other gas) will provide a highly turbulent cleaning solvent/air mixture flow through the piping system to be cleaned.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 shows a schematic view of the instant invention.

DESCRIPTION OF THE PREFERRED EMBODIMENT

Figure 1:
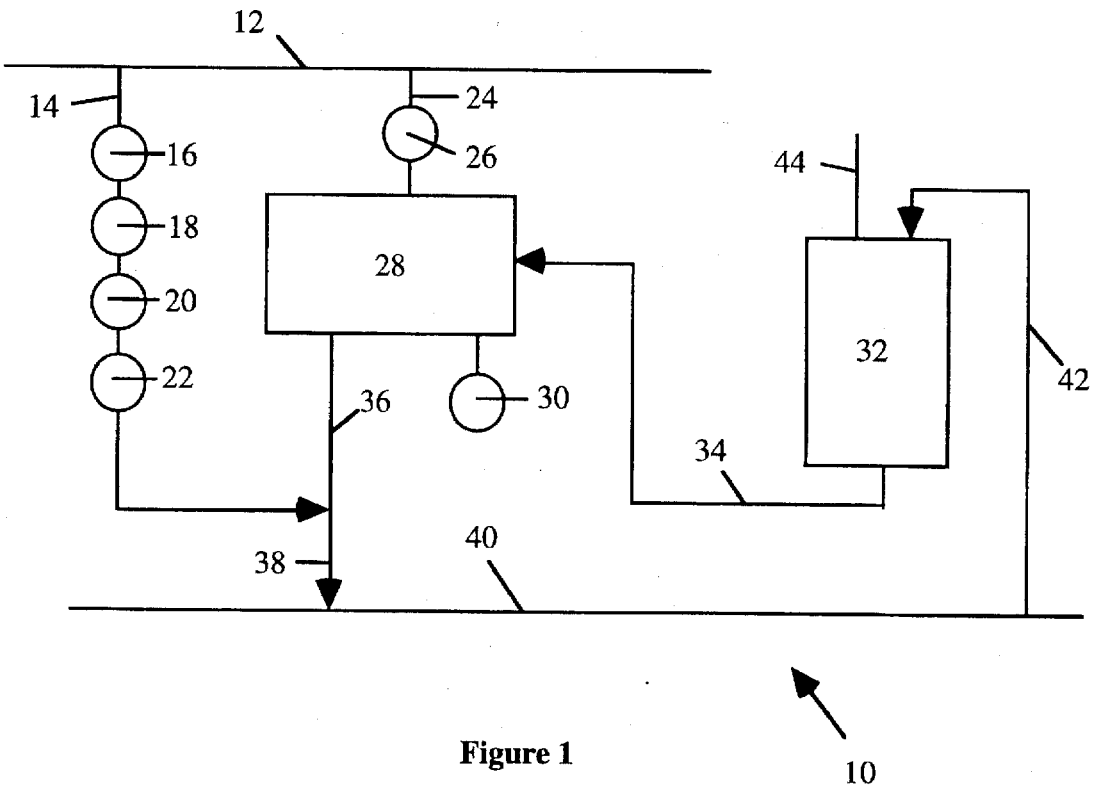

The instant invention is shown in schematic form in FIG. 1 and is generally designated 10.

The cleaning method and apparatus of the instant invention 10 is comprised generally of an air supply means 14 and a fluid supply means 28. Air supply means 14 further comprises in series an air flow meter 16, an air pressure regulator 18, a shutoff valve 20 and a check valve 22. Fluid supply means 28 is attached to a source of fluid such as tank 32 which may be any sort of solvent suited for cleaning the material being circulated in the conduit 40 to be cleaned. Depending upon the material being circulated this may be water or a more traditional organic solvent.

Fluid supply means 28 may be a pneumatic positive displacement pump such as Graco's GLUTTON, HIGH-FLO, HUSKY, CHECKMATE and DURAFLO pumps which additionally has an air control valve 30 attached to the pump air exhaust. Fluid supply means 28 receives fluid via input line 34 from tank 32. Adjustment of this valve 30 serves to limit the flow of fluid through the motor independent of the fluid pressure. This in essence makes these pumps constant output pumps once this valve is set. A valve such as model SP-25 sold by Parker Hannifin Corporation's Pneumatic Division is suitable for air control valve 30. Air pressure to fluid supply means 28 (where such is air-powered) is provided via a drop 24 from air line 12 with a regulator 26 for control.

In another embodiment of the instant invention, fluid supply means 28 can be Graco's TRIUMPH electric motor driven reciprocating piston pump which is set to produce a constant flow rate.

Lastly, a positive displacement gear pump may be provided as the fluid supply means 28 with an electric motor which is controlled by a variable frequency controller to maintain a constant speed at any given motor set point.

For instance if the optimum mixture of fluid and air is 0.5 GPM of fluid and 15 SCFM of air for a one inch pipe 40 to be flushed, then the fluid supply means 28 may be set to have a 0.5 GPM output and a simple air pressure regulator utilized as air supply means 14 which is attached to a source of compressed gas 12 (most typically compressed air but this may be other gases where desired) to provide the desired volume of air.

In order to optimize turbulence and cleaning, the key variable appears to be air velocity which may be measured with an air flow meter and is calculated by dividing the air flow by the cross sectional area of the pipe 40 to be cleaned. An air velocity in the range of 1000–3000 ft./min. will provide optimal results.

As shown in FIG. 1, the outputs of fluid and air supply means 14 & 28 respectively are plumbed together and attached to the conduit 40 to be cleaned. Conduit 40 may be anything from a simple hose up to a spray gun to a fairly substantial circulating system and the principles set forth herein do not vary significantly between types of application. To recirculate the cleaning fluid, return line 42 returns the fluid to tank 32 which is also provided with a vent 44.

It is contemplated that various changes and modifications may be made to the conduit cleaning method & apparatus without departing from the spirit and scope of the invention as defined by the following claims.

What is claimed is:

1. An apparatus for cleaning a fluid conduit, said apparatus comprising:

means for supplying a pressure regulated compressed gas to said conduit; and pumping means for supplying a flow of pressurized solvent to said conduit to be cleaned, said pumping means being capable of variable speeds which provide a constant speed and positive displacement at any predetermined setting in order to produce a turbulent flow cleaning action in said conduit and comprising an air operated reciprocating pump having a fluid outlet and an air exhaust and having means restricting said air exhaust so as to provide a constant output volume at any given setting of said restricting means independent of pressure downstream of said fluid outlet.

* * * * *